United States Patent [19]

Blake

[11] Patent Number: 4,944,431

[45] Date of Patent: Jul. 31, 1990

[54] TRIGGER SPRAYER WITH MULTI-FUNCTION PISTON

[76] Inventor: William S. Blake, 14 Georgetown Ct., Linwood, N.J. 08221

[21] Appl. No.: 248,418

[22] Filed: Sep. 23, 1988

[51] Int. Cl.[5] ..... B67D 5/40

[52] U.S. Cl. ..... 222/276; 222/380; 222/383; 222/545; 239/333

[58] Field of Search ..... 222/321, 375, 378, 380, 222/382, 383, 384, 385, 276; 239/333

[56] References Cited

U.S. PATENT DOCUMENTS

| | | | |
|---|---|---|---|
| 3,913,841 | 10/1975 | Tada | 222/384 X |
| 4,155,487 | 5/1979 | Blake | 222/383 X |
| 4,191,313 | 3/1980 | Blake et al. | 222/383 X |
| 4,273,268 | 6/1981 | Wickenberg | 222/383 X |
| 4,365,751 | 12/1982 | Saito et al. | 222/383 X |
| 4,624,413 | 11/1986 | Corsette | 222/383 X |
| 4,815,663 | 3/1989 | Tada | 222/383 X |

*Primary Examiner*—Joseph J. Rolla
*Assistant Examiner*—Kenneth R. DeRosa
*Attorney, Agent, or Firm*—Dennis H. Lambert

[57] ABSTRACT

A trigger actuated dispenser pump for dispensing product from a container, in which a multi-function piston member has a primary piston reciprocable in a pump chamber and a secondary piston reciprocable in an outlet chamber. The primary piston draws product from the container, pressurizes it and pumps it into the outlet chamber. The secondary piston functions to reduce pressure in the outlet chamber during initial movement of the pump, tending to promote flow from the pump chamber into the outlet chamber. A flow restrictor is positioned in the pump chamber and is operative to limit reverse flow from the pump flow into the container. An outlet valve in the outlet chamber functions to prevent dribbling of product at the end of a discharge or pressure stroke, remaining closed when the pressure of product in the outlet chamber is below a predetermined minimum, and a positive shut-off valve may be positioned in the outlet chamber for precluding flow from the pump when it is an at-rest position.

22 Claims, 5 Drawing Sheets

FIG. 6
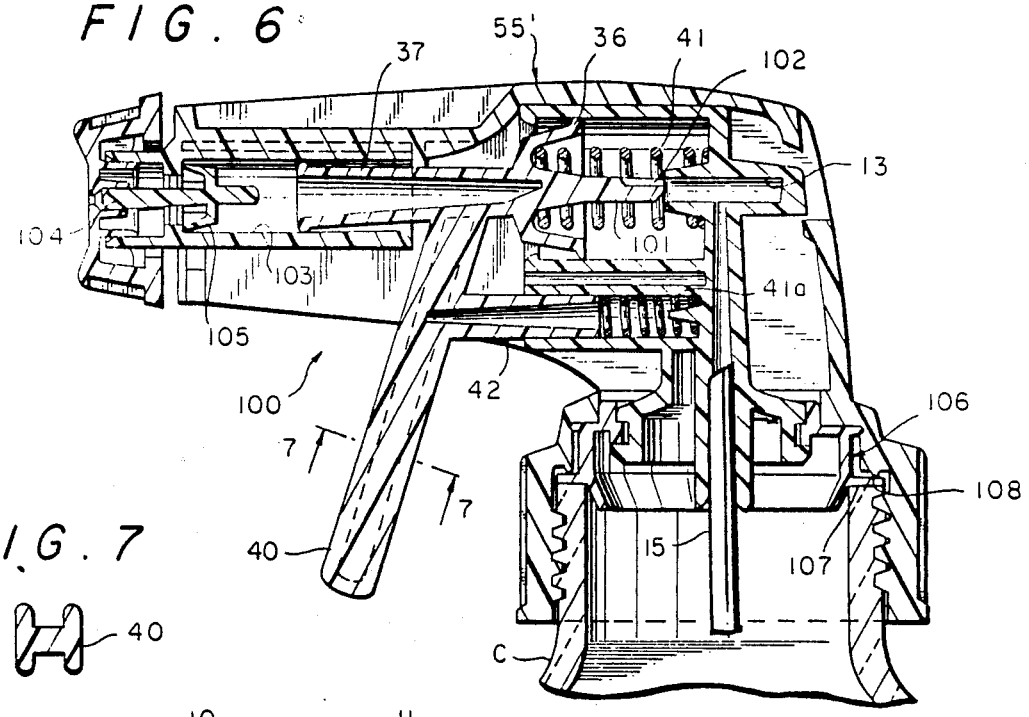
FIG. 7
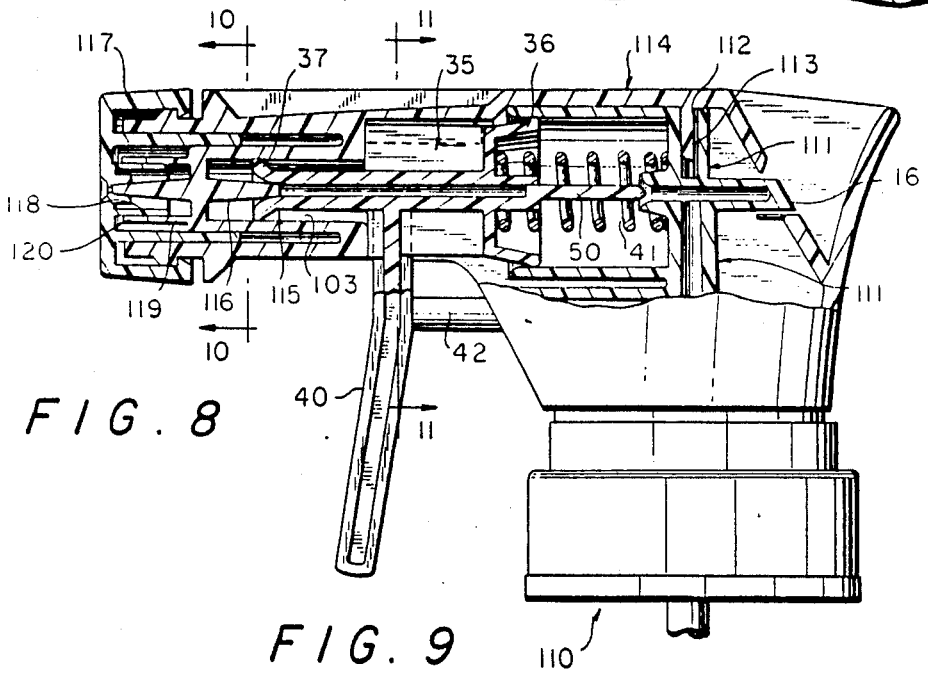
FIG. 8
FIG. 9
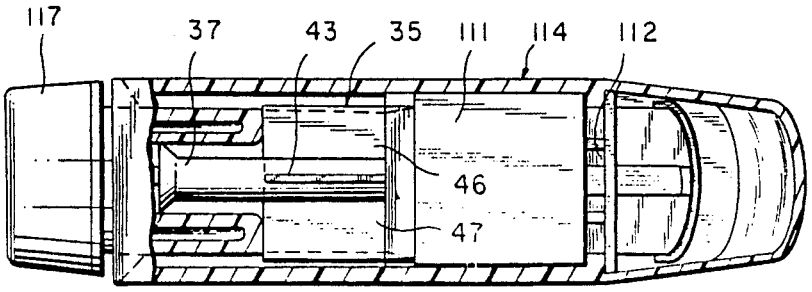

TRIGGER SPRAYER WITH MULTI-FUNCTION PISTON

FIELD OF THE INVENTION

This invention relates to fluid dispensing pumps of the type which are applied to a container and manually operated to dispense product from the container. More particularly, the invention relates to a trigger actuated pump having improved valving and nozzle configurations that reduce manufacturing costs, facilitate assembly, and improve performance.

PRIOR ART

Many different pump constructions are known in the prior art for dispensing a variety of products, including various finger operated pumps and trigger sprayers. Such prior art pumps typically comprise a combination of molded plastic and rubber parts, steel ball valves and springs. These prior art constructions have many parts, are complex, and are relatively costly to manufacture. Further, the pump chamber and valving in most prior art pump constructions enable product to be dispensed by a relatively small and/or slow force applied to the actuator, as by a child, for example.

Additionally, many prior art pumps require complicated and expensive assembly, and large numbers of relatively small parts must be inventoried. Also, conventional molding techniques limit the materials and type of construction which can be used in some parts of prior art pumps. Further, the assembly structure used in some prior art pumps for attaching the shroud to the body makes them susceptible to breakage or disassembly.

In still other prior art pumps of the type having a piston reciprocable in a pump chamber, the forward or return stroke of the piston is accompanied by return of product from the pump chamber into the container. Further, in prior art trigger actuated dispensing pumps, the spray nozzle may either be fixed, or adjustable between "off", "spray" and "stream" positions, and there generally is no means for effecting a positive shut-off or closing of the valve other than through appropriate adjustment of the nozzle.

The molding techniques utilized in making prior art trigger actuated pump dispensers also generally require that the nose piece and/or nozzle configuration be made as a separate part and then assembled to the trigger housing or shroud.

Further, the prior art method of retaining the closure and body to one another and to the container, and for sealing these components relative to one another sometimes requires expensive and complicated structure or may not effect a secure seal or retention of the parts.

Examples of some prior art pump constructions are shown in the following U.S. Pat. Nos.: 3,768,734, 4,155,487, and 4,225,061. Each of these patents possesses one or more of the disadvantages described above, and is thus subject to improvement in spite of the relatively sophisticated structures shown and described therein. For instance, these patents variously utilize rubber bladders and valves, expensive steel ball check valves, relatively weak attachments to subassemblies and containers, and/or require complicated and expensive assembly.

SUMMARY OF THE INVENTION

Accordingly, it is an object of the present invention to provide a pump which is simple and economical in construction.

Another object is to provide a manually operated pump which includes a flow restrictor between the pump inlet and outlet chambers, rendering it child resistant.

A further object is to provide a manually operated pump having dual chambers connected through a passage controlled by a flow restrictor, requiring relatively rapid movement of the actuator to effect a dispensing cycle.

An even further object of the invention is to provide a pump in which the pump assembly and shroud have interfitting means to prevent relative rotational and lateral movement therebetween, thus rendering them less susceptible to breakage or disassembly.

A still further object of the invention is to provide a trigger operated dispensing pump in which a unique molding process is utilized, enabling the nozzle or nose piece to be integrally formed with the shroud.

Another object of the invention is to provide a trigger operated dispensing pump in which a multi-function piston member has primary and secondary pistons thereon for drawing product from the container and pressurizing it, and for maintaining prime of the pump during the return stroke, respectively.

A further object of the invention is to provide a unique mounting means for mounting and sealing the pump to a container.

A still further object of the invention is to provide a trigger actuated pump having shut-off valve means separate from the nozzle valve.

These and other objects and advantages of the invention are achieved by the unique trigger operated, dual function pump of the invention, in which the pump comprises a multi-function piston member reciprocable in a housing and having a primary piston member and a secondary piston member. The primary piston functions to draw product from the container into an inlet or pump chamber and then to pressurize the product and discharge it into an outlet chamber. The secondary piston functions to produce a low pressure in the outlet chamber during the pressurizing stroke of the pump, drawing product from the inlet chamber during the initial stroke of the pump and maintaining the pump in a primed condition. The secondary piston, on the return stroke of the pump in one form of the invention, pressurizes product in the outlet chamber and can effect a continuous flow or discharge of product. An outlet check valve may be interposed between the outlet chamber and the nozzle for stopping flow from the dispenser until a predetermined pressure is reached; and in one form of the invention, a positive shut-off valve may be interposed between the outlet chamber and the nozzle to positively close the pump to flow when the pump is in an at-rest position.

A flow restrictor is disposed between the inlet and outlet chambers, operable to admit flow from the inlet chamber to the outlet chamber upon an intake stroke and to prevent substantial reverse flow between the chambers upon normal actuation of the pump for a dispensing cycle. However, slow actuation of the pump, as might be effected by a child, for example, enables the fluid in the outlet chamber to follow the path of least resistance, i.e., past the restrictor and into the inlet chamber rather than through the outlet valve.

The pump housing has means for interfitting engagement with means on the shroud to resist tampering and strengthen the assembly, making it difficult to remove the shroud from the housing.

Several different nose pieces or nozzle outlet valves are provided, including a positive shut-off valve separate from the nozzle itself for closing off flow of product when the piston is in its at-rest position, independently of the adjusted position of the nozzle.

In one form of the invention, unique molding procedures are used to eliminate the need for a nose valve piece and uses instead a combination of the shroud and nozzle to achieve the desired valving function. In another form, a nose valve part is utilized but the nozzle is formed as an integral part of the shroud.

BRIEF DESCRIPTION OF THE DRAWINGS

The foregoing and other objects and advantages of the invention will become apparent from the following detailed description when considered with the accompanying drawings, in which like reference characters designate like parts throughout the several views, and wherein:

FIG. 6 is an enlarged, vertical, fragmentary sectional view of a first variation of the trigger pump of the invention;

FIG. 7 is an enlarged transverse sectional view of the trigger in the pump of FIG. 6, taken along line 7—7;

FIG. 8 is an enlarged, vertical, longitudinal sectional view of a second variation of the trigger pump of the invention, taken along line 8—8 in FIG. 9;

FIG. 9 is a top view, with portions shown in section, of the trigger of FIG. 8;

DETAILED DESCRIPTION OF THE PREFERRED EMBODIMENTS

Figure 1:
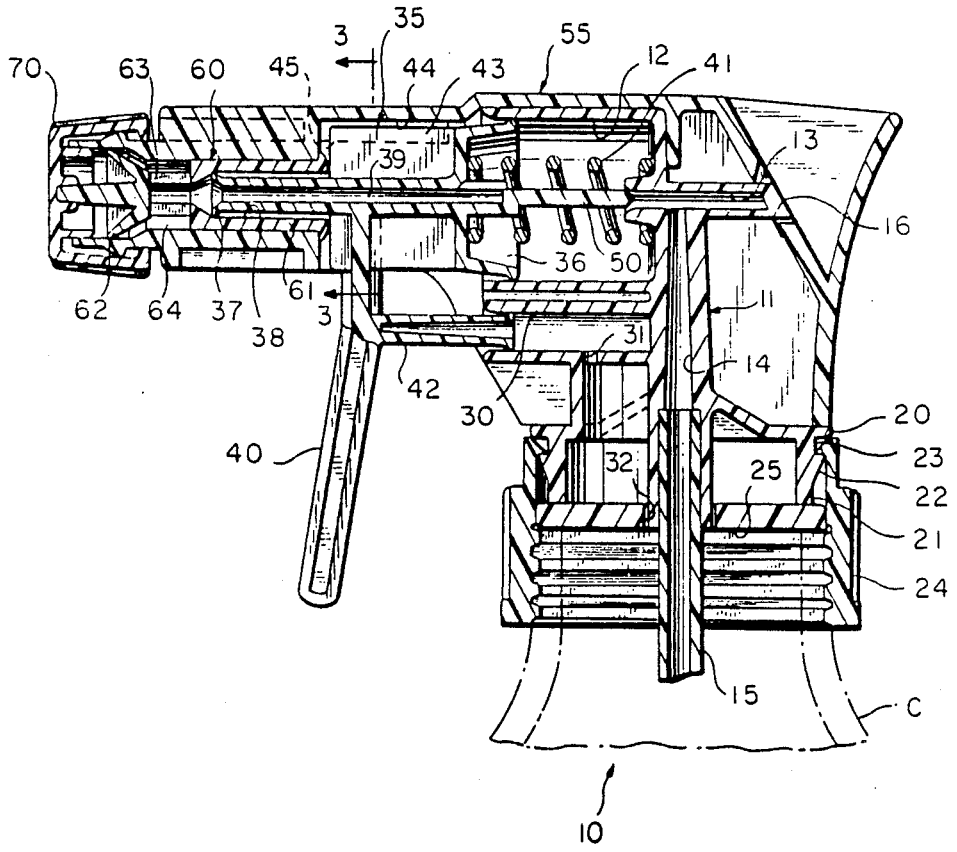
FIG. 1 is a longitudinal vertical sectional view of a trigger actuated pump in accordance with the invention, taken along line 1—1 in FIG. 2.
Figure 2:
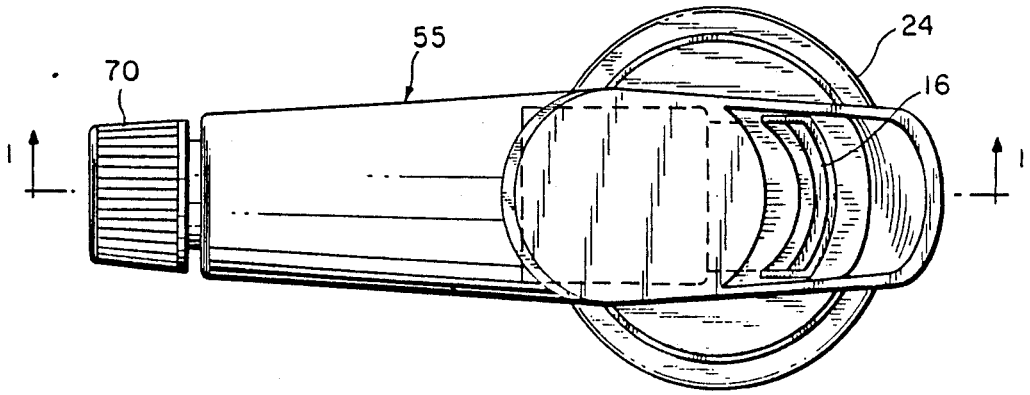
FIG. 2 is a top plan view of the trigger of FIG. 1.

With more specific reference to the drawings, a first form of trigger actuated dispenser pump according to the invention is indicated generally at 10 in FIGS. 1-4. The trigger pump comprises a pump body or housing 11 having a cylindrical pump or inlet chamber 12 formed at an upper end portion thereof. An inlet passage 13 communicates at one end with the rear of the pump chamber, and includes an elongate vertical passage 14 extending downwardly through the housing for receiving product from a dip tube 15. As seen best in FIGS. 1 and 2, that portion of the housing containing inlet passage 13 is shaped with a rearwardly extending projection 16.

The lower portion of the housing comprises a radially outwardly directed flange 20 with a depending cylindrical skirt 21 on the underside thereof. An upwardly facing snap detent shoulder 22 is formed on the outer surface of the skirt 21, and with the flange 20 defines an annular pocket 23 for receiving the upper end of a closure 24 for securing the pump to a container "C". A suitable gasket 25 is preferably disposed beneath the lower end of the skirt 21 for compression between the skirt and the upper end of the container neck.

A trigger guide and vent chamber 30 is formed in the housing beneath the piston chamber, and a vent passage 31 establishes communication between this chamber and the interior of the housing defined by the skirt 21. A vent passage 32 is also provided through the gasket 25 for establishing communication from the interior of the container to ambient atmosphere through the vent passages 31 and interior of the housing.

A trigger actuated piston pump 35 is assembled to the housing, along with a shroud 55, nose valve 60 and nozzle 70 to define the completed pump assembly.

The piston pump 35 comprises a primary piston 36 reciprocable in the pump chamber 12, and a secondary piston 37 reciprocable in an outlet chamber 38 defined in a rearwardly extending portion 61 of the nose valve 60. Communication from the pump chamber to the outlet chamber is through a passage 39 extending axially through the piston member.

The pistons 36 and 37 are caused to be reciprocated rearwardly in the housing and shroud by a trigger actuator 40, and a return spring 41 disposed in the pump chamber 12 engages the primary piston to return the pump to its forward, at-rest position as shown in FIG. 1.

A vent valve 42 extends rearwardly from the trigger and into the vent chamber 30 for controlling opening and closing of the vent opening 31 in timed relationship with movement of the piston pump.

Figure 3:
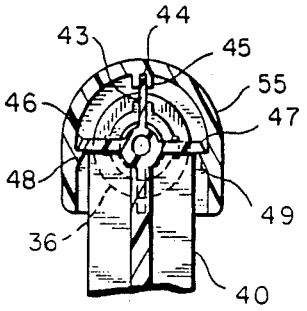
FIG. 3 is a transverse sectional view of the trigger of FIG. 1, taken along line 3—3.

With reference to FIGS. 1 and 3, movement of the pump in the housing and shroud is guided by an upstanding fin 43 formed on the pump piston and sliding at its upper edge in a channel 44 defined by spaced walls or flanges 45 in the underside of the shroud top wall. In addition, a pair of horizontally projecting guide wings 46 and 47 extend from opposite sides of the piston and slide at their outer ends on shoulders 48 and 49, respectively, formed on the inside surfaces of the side walls of the shroud.

A valve pintle 50 projects rearwardly from the center of piston 36 and extends into the inlet passage 13 for controlling flow therethrough. In this regard, the pintle serves to form a restricted passage, rather than completely closing off flow. Consequently, rapid rearward movement of the piston will result in product following the path of least resistance, i.e., forwardly through the piston to the outlet chamber. On the other hand, slow rearward movement of the piston and pintle will enable product to leak past the pintle and return to the container.

The nose valve 60, in addition to the rearwardly extending portion 61 defining outlet chamber 38, has a forwardly extending flap valve 62 which is normally seated against the inner surface of the nose piece of the shroud, shutting off flow through the pump.

In operation, the trigger is pulled rearwardly to move both the primary and secondary pistons 36 and 37, respectively, rearwardly, decreasing the volume of the pump chamber and enlarging the volume of the outlet chamber. Assuming that the pump has been previously primed, this action pressurizes the fluid in the pump chamber and causes it to flow forwardly through the passage 39, outwardly through the ports 63 in the nose valve, and into the annular space 64 around the valve flap 62. Upon the pressure reaching a predetermined value, the valve 62 opens, enabling the fluid to escape through the nozzle. Also, during the pressure stroke of the pump the vent valve 42 moves past the vent opening 31 and vents atmospheric pressure to the interior of the container.

It should be noted that as the pump is moved rearwardly, the pintle 50 enters the inlet passage 13, restricting flow from the pump chamber back through the dip tube to the container. Further, the secondary piston 37, by functioning to enlarge the outlet chamber during a pressure stroke of the primary piston, serves to draw fluid from the pump chamber and into the outlet chamber, at least partially overcoming the tendency of the fluid to flow back through the inlet passage. This action helps to maintain prime of the pump once established.

Additionally, the outlet valve or nose valve 62 prevents dribble of product from the dispenser as the pressure falls below a predetermined minimum.

To assemble the dispenser of the invention, the spring 41 is first inserted into the pump chamber 12, followed by the piston 36, which is pushed rearwardly to fully compress the spring. The housing and piston are then tilted with the forward edge disposed upwardly and the piston 37 is inserted into the outlet chamber 38, after which the housing and piston are pivoted upwardly into the shroud, whereupon the parts become snap-engaged to maintain them in assembled relationship, i.e., projection 16 on the rear of the housing enters the cut-out in the shroud, and the guides on the trigger engage the complemental guides on the shroud.

Figure 4:
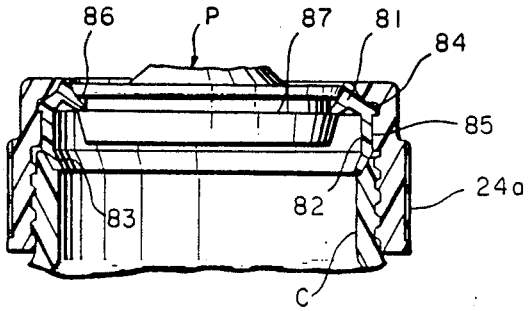
FIG. 4 is an enlarged fragmentary sectional view of a first form of attaching and sealing means for securing the pump to a container.

A first variation of attachment and sealing means for securing the dispensing pump to a container is shown at 80 in FIG. 4. In this form of the invention, a combined sealing and locking member 81 is adapted to be snap-engaged between the closure **24*a* and the pump P. The locking member 81 includes a cylindrical body 82 having an angularly inwardly inclined sealing flange 83 on its lower end for engagement against the end of the container neck, and an outwardly directed flange 84 for snap engagement behind a shoulder 85 in the closure 24*a*. A second downwardly and inwardly inclined locking flange 86 on the upper end of the locking member engages behind a shoulder 87** on the bottom of the pump for retaining the pump, closure and locking member in assembled relationship.

Figure 5:
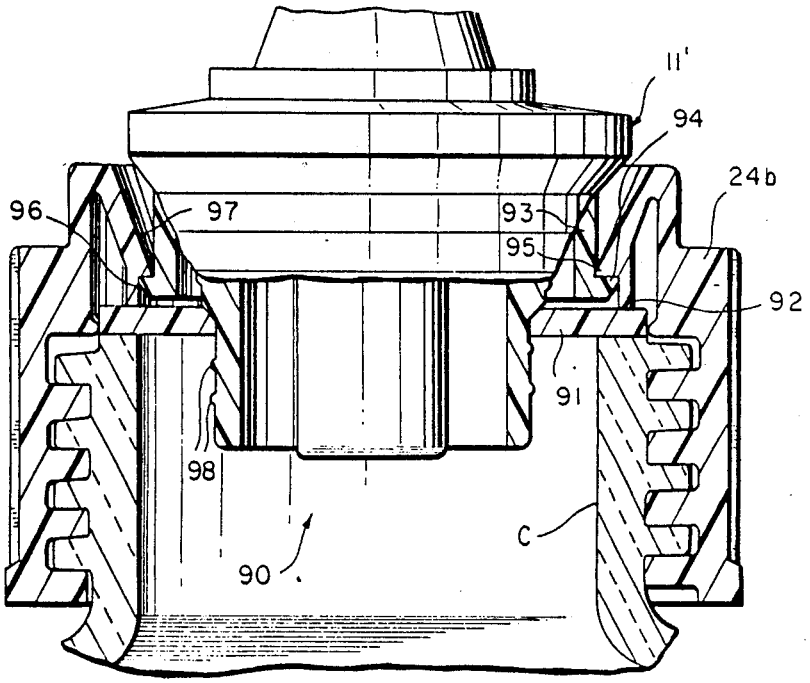
FIG. 5 is an enlarged, fragmentary, vertical sectional view of a second form of attaching and sealing means for securing the pump to the container.
Figure 10:
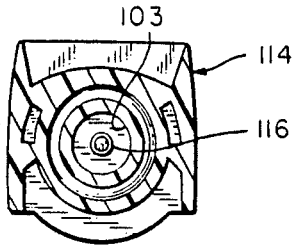
FIG. 10 is a transverse sectional view of the pump of FIG. 8, taken along line 10—10.
Figure 11:
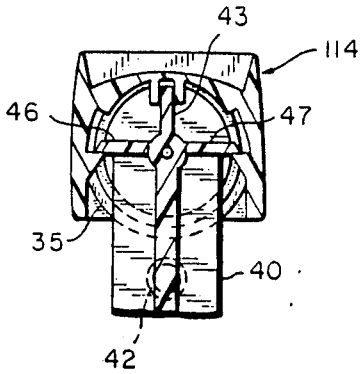
FIG. 11 is a transverse sectional view of the pump of FIG. 8, taken along line 11—11.

A second variation of the attaching and sealing means for securing the pump to a container is indicated generally at 90 in FIG. 5. In this form of the invention, a separate gasket 91 is interposed between the end of the container C and an axially downwardly extending compression flange 92 on the closure **24*b*. The bottom end of the pump housing 11' has a depending skirt 93 with a radially outwardly extending locking flange 94 on the bottom edge thereof for locking engagement behind a locking shoulder 95 on the closure. Tapered surfaces 96 and 97 on the locking flange 94 and closure 24*b*, respectively, facilitate assembly of the components into the mutually locked together relationship shown in FIG. 5, and retaining beads 98** on the outer bottom end surface of the housing serve to retain the gasket on the pump when disassembled from the container.

A first modification of the pump is indicated generally at 100 in FIGS. 6 and 7. In this form of the invention, the pump operates in essentially the same way as that shown in FIG. 1 in that it has a primary piston 36, a secondary piston 37 and a vent valve 42 all operated in unison by trigger actuator 40. However, in this form of the invention the pintle valve 101 has a cut-out 102 formed adjacent the free end thereof for increased flow past the pintle during initial insertion into the inlet passage 13. Alternatively, cut-outs may be provided in the wall of the inlet chamber. Thus, the piston may be operated over a short stroke (less than a full stroke of the trigger, with the end of the pintle remaining in the inlet passage), and fluid is still enabled to flow past the piston and into the pump chamber. Of course, the secondary piston 37 functions just as before to create a low pressure in the outlet chamber and prevent loss of prime. Also, a second spring **41*a*** may be engaged against the vent valve to assist in returning the piston member to an at-rest position.

In addition, the secondary piston does not slide in an outlet chamber formed by an extension of the nose valve, but instead is slidable in an outlet cylinder 103 formed in the nose portion of the shroud 55'. The nose valve itself, 104, does not have the rearwardly extending portion of the embodiment of FIG. 1, but does have the flap valve 105 which is normally seated against the inner wall of cylinder 103 to shut off flow below a predetermined pressure and when the pump is at rest.

Further, this form of the invention shows yet another variation of attaching and sealing means 106 for securing the pump to the container. This means comprises a locking ring similar to that shown in FIG. 4, but includes a radially outwardly projecting sealing flange 107 which is compressed between the end of the container and a compression flange 108 on the inside of the top wall of the closure.

A second modification of the trigger actuated pump is indicated generally at 110 in FIGS. 8–11. In this form of the invention, the pump comprises a piston member 35 substantially the same as that shown in FIG. 1. However, the body or housing 111 includes a channel 112 in an upper portion thereof for receiving a depending flange 113 on the shroud 114, thus forming a secure assembly.

Further, in this form of the invention a second, positive acting valve closure 115 is provided by pintle 116 on the shroud nose piece projecting rearwardly into a position to enter and close off the passage 39 through the piston when the piston is in its at-rest position.

The nozzle 117 in this form of the invention is formed of a relatively soft material, with a flexible cylindrical wall 118 extending concentrically inside wall 119 on the shroud to define a flap valve closure which remains closed until the pressure reaches a predetermined minimum. Ports 120 are formed through the wall 119 to facilitate flow of product.

Figure 12:
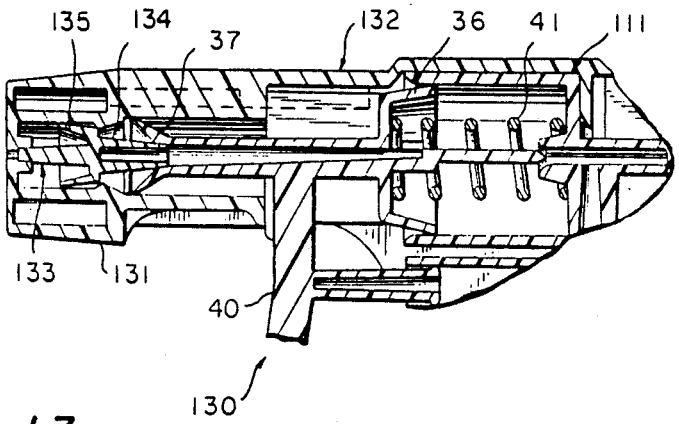
FIG. 12 is an enlarged, fragmentary, longitudinal vertical sectional view of a third variation of the pump of the invention.

In FIG. 12, a further modification is indicated at 130. This form of the invention is similar to that shown in FIGS. 8–11, except that the nozzle 131 is formed integrally with the shroud 132, and a separate nose valve 133 is inserted into the nose piece. The positive shut-off valve pintle 134 is formed on the nose valve 133 rather than on the shroud as in the previous form of the invention, and the outlet flap valve 135 is formed on the nose valve rather than on the nozzle.

Figure 13:
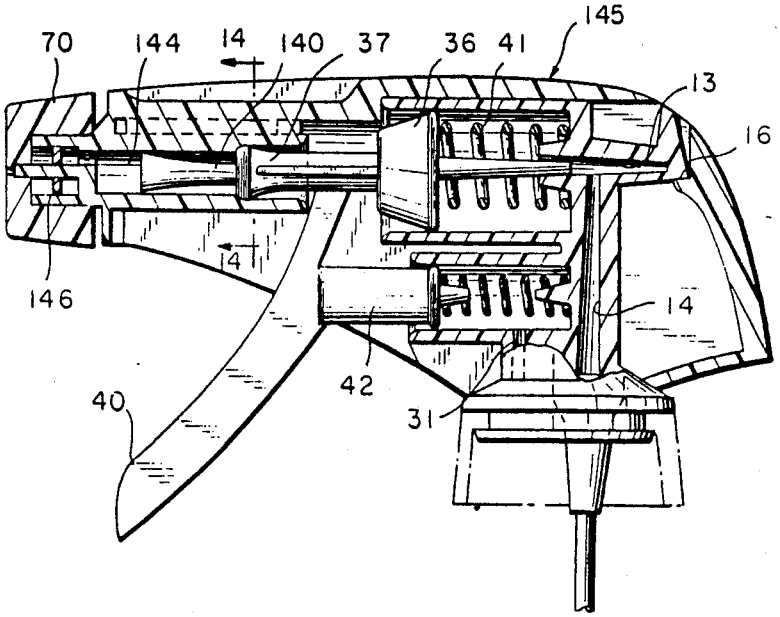
FIG. 13 is a view similar to FIG. 8 of a fourth variation of the pump of the invention.
Figure 14:
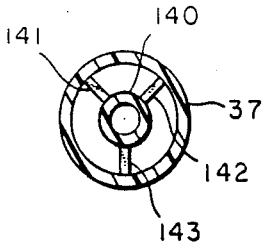
FIG. 14 is a transverse sectional view taken along line 14—14 in FIG. 13.

FIGS. 13 and 14 represent yet another modification of the trigger actuated pump of the invention. In this form, the outlet flap valve is formed by a forwardly projecting member 140 extending essentially coaxially with the secondary piston 37 and joined thereto by radial webs 141, 142 and 143. The outlet flap valve 140 slides in a cylindrical outlet chamber 144 defined in the shroud 145. This form of the invention will provide a spray or discharge of fluid upon movement of the piston in either direction and is thus a continuous or semi-continuous sprayer. If desired, a washer-like outlet valve 146 may be provided in the nose piece of the shroud to prevent dribble at the end of a pressure stroke. A spring (not shown) could also be provided in the vent chamber, if desired, for acting on the vent valve to assist in returning the pump to its at-rest position, as shown in FIG. 6.

Figure 15:
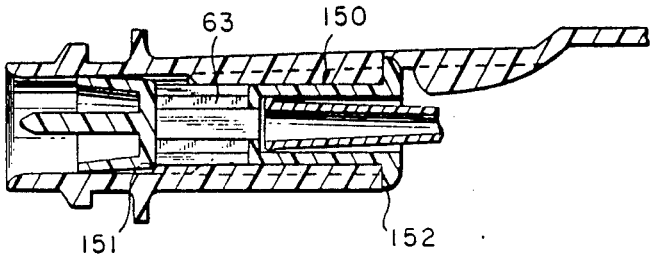
FIG. 15 is an enlarged, fragmentary, vertical sectional view of a modified nose piece and valve which may be used in lieu of those previously shown.
Figure 16:
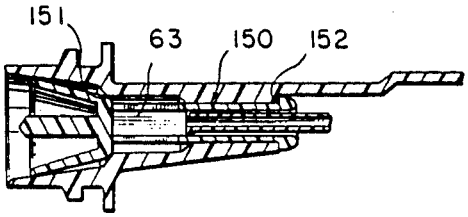
FIG. 16 is a view similar to FIG. 15 of a further modification of the nose piece and valve.
Figure 17:
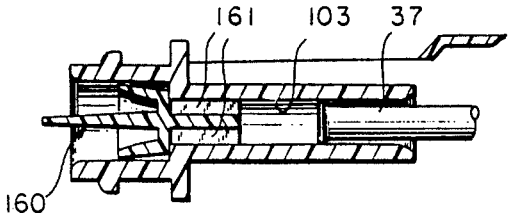
FIG. 17 is a view similar to FIG. 15 of a still further modification of the nose piece and valve.
Figure 18:
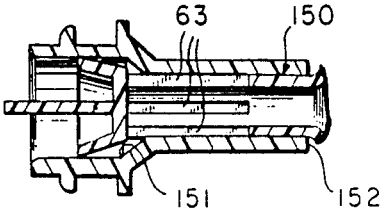
FIG. 18 is a view similar to FIG. 15 of yet another modification of the nose piece and valve.

The nose piece and valve configurations of FIGS. 15–18 represent variations from those earlier described. For instance, the structure shown in FIGS. 15, 16 and 18 are similar to that shown in FIG. 1, except that the nose valve 150 of these figures is engaged between a pair of shoulders 151 and 152 in the shroud.

The valve 160 shown in FIG. 17, on the other hand, is more like that shown in FIG. 6, in that the secondary piston 37 slides in a housing 103 formed in the shroud, rather than in an extension of the valve. In this form of the invention, the valve has a tail piece 161 of fluted configuration for snug engagement in the cylinder 103.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

I claim:

1. A dispenser pump to be mounted on a container for dispensing product from the container, comprising:

means defining a pump chamber for receiving product from the container through an inlet passage;

means defining an outlet chamber for receiving product from the pump chamber;

outlet passage means extending from the pump chamber to the outlet chamber for conveying product from the pump chamber to the outlet chamber; and pump means including primary piston means and secondary piston means reciprocable in the pump chamber and outlet chamber, respectively, said primary piston means being operable to decrease the volume of the pump chamber upon a pressure stroke of the pump means to thereby pressurize product in the pump chamber, and said secondary piston means being operable upon said pressure stroke to enlarge the volume of the outlet chamber and create a low pressure therein upon initial movement of the pump means on a pressure stroke for drawing product from the pump chamber and through the outlet passage to the outlet chamber, whereby flow of product from the pump chamber to the outlet chamber is enhanced and prime of the pump is maintained during initial movement on a pressure stroke.

2. A dispenser pump as claimed in claim 1, wherein:

flow restrictor means is interposed between said inlet passage and said pump chamber, operable in response to movement of said pump means to restrict flow from the pump chamber to the inlet passage.

3. A dispenser pump as claimed in claim 2, wherein:

said flow restrictor comprises a valve pintle extending from said primary piston into said inlet passage.

4. A dispenser pump as claimed in claim 3, wherein:

one of said valve pintle and inlet passage has cutouts therein for enabling less restricted flow when the pintle is initially inserted into the inlet passage, whereby the pump means may be operated through less than a full stroke and product is enabled to flow from the inlet passage into the pump chamber upon a return stroke of the pump means.

5. A dispenser pump as claimed in claim 2, wherein:

an outlet valve is connected with said outlet chamber for controlling flow from the outlet chamber, said outlet valve normally being closed but being opened when the pump means is operated on a pressure stroke and the pressure of product in the outlet chamber reaches a predetermined minimum.

6. A dispenser pump as claimed in claim 5, wherein:

said pump means includes a housing means;

said pump chamber being defined in said housing means;

a shroud secured to said housing means in covering relationship thereto;

said outlet chamber being defined in said shroud;

said housing means and shroud have snap detent means thereon for snap-fitting engagement with one another to secure the parts together in assembled relationship; and said outlet valve is separately formed from the shroud and the housing and is secured in a nose piece of said shroud, said outlet valve having a rearwardly projecting extension defining said outlet chamber in which said secondary piston is reciprocable.

7. A dispenser pump as claimed in claim 5, wherein:

said pump means includes a housing means;

said pump chamber being defined in said housing means;

a shroud secured to said housing means in covering relationship thereto;

said outlet chamber being defined in said shroud;

said housing means and shroud have snap detent means thereon for snap-fitting engagement with one another to secure the parts together in assembled relationship; and said outlet valve comprises a flexible cylindrical wall formed on a nozzle engaged on the shroud, said wall being disposed concentrically against an inner surface of the shroud to preclude flow through the nozzle until the pressure in the outlet chamber reaches a predetermined minimum and flexes the wall away from the shroud, said outlet chamber being formed in the shroud.

8. A dispenser pump as claimed in claim 5, wherein:

a positive shut-off valve is positioned between said pump chamber and the outlet chamber to positively prevent flow from the pump chamber to the outlet chamber when the pump is in an at-rest position.

9. A dispenser pump as claimed in claim 8, wherein:
said pump means includes a housing means;
said pump chamber being defined in said housing means;
a shroud secured to said housing means in covering relationship thereto;
said outlet chamber being defined in said shroud;
said housing means and shroud have snap detent means thereon for snap-fitting engagement with one another to secure the parts together in assembled relationship; and
said outlet valve is separately formed from the shroud and the housing and is secured in a nose piece of said shroud, said outlet valve having a valve pintle projecting rearwardly therefrom and defining the positive shut-off valve.

10. A dispenser pump as claimed in claim 8, wherein:
said pump means includes a housing means;
said pump chamber being defined in said housing means;
a shroud secured to said housing means in covering relationship thereto;
said outlet chamber being defined in said shroud;
said housing means and shroud have snap detent means thereon for snap-fitting engagement with one another to secure the parts together in assembled relationship; and
said outlet valve is separately formed from the shroud and the housing and is secured in a nose piece of said shroud.

11. A dispenser pump as claimed in claim 8, wherein:
said primary and secondary piston means are formed on opposite ends of a piston member reciprocable in said pump chamber and outlet chamber.

12. A dispenser pump as claimed in claim 11, wherein:
said outlet passage means extends axially through said piston member; and
said positive shut-off valve comprises a valve pintle in said outlet chamber positioned to extend into said outlet passage through said piston member when the piston member is in its at-rest position.

13. A dispenser pump as claimed in claim 11, wherein:
an actuator is connected with said piston member to reciprocate it on a pressure stroke; and
spring means is engaged with said piston member to reciprocate it on a return stroke.

14. A dispenser pump as claimed in claim 13, wherein:
a vent valve is connected to be operated by movement of said actuator, said vent valve being reciprocable in a vent chamber having a vent opening for establishing communication between atmosphere and the interior of the container, and operable to open and close said vent opening upon movement of the actuator.

15. A dispenser pump as claimed in claim 13, wherein:
said pump means includes a housing means;
said pump chamber being defined in said housing means;
a shroud secured to said housing means in covering relationship thereto;
said outlet chamber being defined in said shroud; and
said housing means and shroud have snap detent means thereon for snap-fitting engagement with one another to secure the parts together in assembled relationship.

16. A dispenser pump as claimed in claim 15, wherein:
said housing means has attachment means thereon for securing the housing to a container.

17. A dispenser pump as claimed in claim 16, wherein:
said attachment means comprises a radially outwardly directed flange for cooperation with a closure adapted to be secured on a container.

18. A dispenser pump as claimed in claim 17, wherein:
said housing has a depending cylindrical skirt, and said flange is formed on an outer surface of said skirt; and
the bottom end of said skirt is adapted to engage against and effect a seal with a gasket interposed between said skirt and the top of a container.

19. A dispenser pump as claimed in claim 17, wherein:
a locking and sealing member is engaged between the housing and closure, said locking and sealing member having an angularly inwardly and downwardly inclined flange on a lower end thereof adapted to engage a complementally inclined surface on the upper end of the container;
a radially outwardly extending flange on the locking member for snap engagement with the closure to retain the closure and locking member in assembled relationship; and
an angularly inwardly and downwardly inclined flange on an upper end of the locking and sealing member engaged with the flange on the housing to maintain the housing assembled with the locking member and closure.

20. A dispenser pump as claimed in claim 17, wherein:
said housing has a tail piece projecting below said flange;
a sealing gasket engaged on said tail piece and adapted to lie against the upper end of a container;
said tail piece having detent means thereon for retaining said gasket assembled on the housing; and
said closure having a downwardly and inwardly sloping surface terminating at its bottom end in a retaining shoulder for snap engagement with the flange on the housing to retain the housing and closure in assembled relationship, said closure having a depending cylindrical compression skirt adapted to engage against and compress the gasket between the skirt and the upper end of the container.

21. In a trigger actuated dispensing pump having a pump body, a piston reciprocable in the pump body, a trigger actuator connected with the piston to reciprocate it, and a shroud enclosing the piston and body, said shroud having a top wall and depending side walls, the improvement comprising:
piston guide means on the shroud and piston for guiding the piston in its movement, said guide means comprising mutually interengaged, longitudinally extending fin and channel means on the top of the piston and on an inner surface of the shroud top wall, and a pair of opposite, horizontally outwardly projecting guide fins on the sides of the piston snap-engaged behind a pair of complemental, inwardly projecting shoulders on the side walls of the shroud for supporting and guiding the fins on the piston and for assisting in retaining the piston in the housing and shroud.

22. A trigger actuated dispenser pump, comprising:
a housing;
a shroud secured over the housing;
means in said housing and shroud defining a pump chamber and an outlet chamber;

a nozzle outlet for receiving product to be dispensed from said outlet chamber;

a multi-function pump having a primary piston on one end reciprocable in the pump chamber and a secondary piston on the other end reciprocable in the outlet chamber; and a combined outlet valve and continuous flow piston carried by said secondary piston and extending coaxially therefrom into said outlet chamber, said combination outlet valve and continuous flow piston comprising an outwardly flared, resiliently yieldable wall slidably engaged in said outlet chamber, said outlet valve being operable to flex away from the wall to enable flow therepast when the pressure of product in the outlet chamber reaches a predetermined minimum value on a pressure stroke of the piston, and to force product from the outlet chamber through the outlet nozzle upon a return stroke of the piston.

* * * * *